US006287033B1

(12) United States Patent
Hatakeyama et al.

(10) Patent No.: US 6,287,033 B1
(45) Date of Patent: Sep. 11, 2001

(54) SHEET CONVEYING ROLLER WITH SURFACE PROJECTIONS

(75) Inventors: Seiji Hatakeyama; Mitsuru Sawano, both of Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/220,761

(22) Filed: Dec. 28, 1998

(30) Foreign Application Priority Data

Dec. 26, 1997 (JP) ..... 9-360925

(51) Int. Cl.[7] ..... B41J 13/02

(52) U.S. Cl. ..... 400/636; 400/641; 492/33; 492/36

(58) Field of Search ..... 400/662, 636, 400/636.1, 636.2, 636.3, 637, 637.1, 637.2, 637.3, 637.4, 637.5, 637.6, 638, 639, 641; 226/193; 492/30, 31, 33, 35, 36

(56) References Cited

U.S. PATENT DOCUMENTS

| | | | | |
|---|---|---|---|---|
| 1,681,875 | * | 8/1928 | Penney | 492/33 |
| 4,683,480 | * | 7/1987 | Sakamoto et al. | 400/636 |
| 5,343,807 | * | 9/1994 | Hackelborger et al. | 101/415.1 |
| 5,351,069 | * | 9/1994 | Koike et al. | 347/215 |
| 5,645,361 | * | 7/1997 | Mitsushima et al. | 400/636 |
| 5,921,687 | * | 7/1999 | Koike et al. | 400/636 |

FOREIGN PATENT DOCUMENTS

| | | | |
|---|---|---|---|
| 197 01 542 | 7/1997 | (DE) | F16C/13/00 |
| 0 373 481 | 6/1990 | (EP) | B65H/27/00 |
| 0 654 756 | 5/1995 | (EP) | G06K/15/00 |
| 0 832 835 | 4/1998 | (EP) | B65H/27/00 |
| 0 838 419 | 4/1998 | (EP) | B65H/5/06 |
| 0 861 798 | 9/1998 | (EP) | B65H/27/00 |
| 2 192 254 | 1/1988 | (GB) | F16C/13/00 |
| 56144169 | * 11/1981 | (JP) | 101/93.04 |
| 61-272390 | * 12/1986 | (JP) . | |
| WO 98/09903 | 3/1998 | (WO) | B65H/27/00 |

OTHER PUBLICATIONS

Patent Abstracts of Japan vol. 1996, No. 8, Aug. 30, 1996 & JP 08 085646 A (Shinko Electric Co., Ltd.) Apr. 2, 1996 Abstract.

Patent Abstracts of Japan vol. 1997, No. 11, Nov. 28, 1997 & JP 09 188433 A (Piolax INC) Jul. 22, 1997 Abstract.

Patent Abstracts of Japan vol. 1997, No. 11, Nov. 28, 1997 & JP 09 175688 A (Alps Electric Co., Ltd.), Jul. 8, 1997 Abstract.

Patent Abstracts of Japan vol. 010, No. 134 (M–479) May 17, 1986 & JP 60 258050 A (Toshiba KK) Dec. 19, 1985 Abstract.

* cited by examiner

*Primary Examiner*—John S. Hilten
*Assistant Examiner*—Daniel J. Colilla
(74) *Attorney, Agent, or Firm*—Sughrue, Mion, Zinn, MacPeak & Seas, PLLC

(57) ABSTRACT

A sheet conveying mechanism for a printer which records an image on a sheet fed from a sheet feeder, includes a hard pinch roller; and a capstan roller confronting the pinch roller, the capstan roller associating with the pinch roller to convey at least one sheet. The capstan roller has a surface on which a plurality of projections are formed. The height of the projections is 60 $\mu$m±40 $\mu$m, a projection pitch in an axial direction of the capstan roller is 0.5 mm±0.2 mm, and the projections are arranged on half or more of the area of the surface of the capstan roller.

5 Claims, 14 Drawing Sheets

FIG. 14 REGISTRATION ACCURACIES IN ACCORDANCE WITH CAPSTAN ROLLER AND PINCH ROLLER

| (1) | | (2) | (3) | (4) | | | | | | | | | | | |
|---|---|---|---|---|---|---|---|---|---|---|---|---|---|---|---|
| CAPSTAN ROLLER | | PINCH ROLLER | IMAGE | TORQUE OF TONER WINDING SHAFT (kgf · cm) | | | | | | | | | | | |
| | | | | 2.00 | 3.00 | 4.00 | 5.00 | 6.00 | 6.50 | 7.50 | 8.50 | 9.00 | 10.00 | 11.00 | |
| SPRAY (#240) | | HARDNESS 40° COMB TEETH | LAT4 (n = 3) | NUMBER OF DEVIATED SHEETS | | | | 3 | 3 | 2 | 0 | 0 | — | — | COMPARATIVE EXAMPLE 1 |
| | | HARDNESS 50° COMB TEETH | | | | | | | 3 | 1 | 1 | 0 | — | — | COMPARATIVE EXAMPLE 2 |
| | | HARDNESS 70° COMB TEETH | | | | | | 3 | 3 | 3 | 3 | 3 | 3 | 3 | COMPARATIVE EXAMPLE 3 |
| a TYPE | GRID HEIGHT = 60μm PITCH P = 0.5mm | HARDNESS 40° (1) COMB TEETH | | — | — | — | — | — | — | 3 | 3 | 3 | 1 | — | COMPARATIVE EXAMPLE 4 |
| | | HARDNESS 40° (2) COMB TEETH | | — | — | — | — | — | 3 | 3 | 3 | — | — | — | COMPARATIVE EXAMPLE 5 |
| | | HARDNESS 50° COMB TEETH | | — | — | — | — | — | 3 | 3 | 3 | 3 | 0 | — | COMPARATIVE EXAMPLE 6 |
| | | HARDNESS 60° COMB TEETH | | — | — | — | 0 | 0 | 0 | 0 | 0 | 0 | 0 | — | EXAMPLE 1 |
| | | HARDNESS 70° COMB TEETH | | 0 | 0 | 0 | 0 | 0 | 0 | 0 | 0 | 0 | 0 | 0 | EXAMPLE 2 |
| | HEIGHT = 80μm P = 0.3mm | HARDNESS 70° COMB TEETH | | — | — | — | — | — | — | 3 | 3 | 3 | 3 | 3 | COMPARATIVE EXAMPLE 7 |
| | HEIGHT = 60μm P = 0.5mm | HARDNESS 50° STRAIGHT + BACKUP | | — | — | — | — | — | — | 1 | 0 | 0 | 0 | 0 | COMPARATIVE EXAMPLE 8 |
| | | HARDNESS 70° STRAIGHT + BACKUP | | — | — | 0 | 0 | 0 | 0 | 0 | 0 | 0 | 0 | — | EXAMPLE 3 |
| | HEIGHT = 55μm P = 0.5mm | HARDNESS 80° STRAIGHT + BACKUP | | — | 0 | 0 | 0 | 0 | 0 | 0 | 0 | 0 | 0 | 0 | EXAMPLE 4 |
| | | | LAT2 (n = 3) | — | 0 | 0 | 0 | 0 | 0 | 0 | 0 | 0 | 0 | 0 | EXAMPLE 5 |
| b TYPE | HEIGHT = 50μm, P = 0.5mm | HARDNESS 70° STRAIGHT + BACKUP | LAT4 (n = 3) | — | — | 0 | 0 | 0 | 0 | 0 | 0 | 0 | 0 | — | EXAMPLE 6 |
| | HEIGHT = 60μm, P = 0.5mm | | | — | — | 0 | 0 | 0 | 0 | 0 | 0 | 0 | 0 | — | EXAMPLE 7 |
| | HEIGHT = 70μm, P = 0.5mm | | | — | — | 0 | 0 | 0 | 0 | 0 | 0 | 0 | 0 | — | EXAMPLE 8 |

SHEET CONVEYING ROLLER WITH SURFACE PROJECTIONS

BACKGROUND OF THE INVENTION

1. Field of the Invention

The present invention relates to a sheet conveying apparatus. More particularly, the present invention relates to a sheet conveying mechanism which is capable of preventing occurrence of deviation of registration (hereinafter called "registration deviation") in a printer.

The present application is based on Japanese Patent Applications Nos. Hei. 9-360925 and 10-356282, the content of which is incorporated hereinto by reference.

2. Description of the Related Art

Conveyance of paper in a thermal printer has been mainly performed by any one of three methods which are a grip roller drive method, a platen roller drive method and a drum drive method. Among the foregoing methods, printers adaptable to a somewhat large sheet size of about A3-size employ the grip roller method structured as shown in FIG. 15. Referring to FIG. 15, reference numeral 101 represents a platen roller disposed opposite to a thermal head 100 and arranged to rotate counterclockwise so as to convey sheets 103 and apply a predetermined pressure to the thermal head 100 so as to press the recording sheet 103 and a toner ribbon 102 guided by a guide roller 104. Moreover, a roller pair comprised of a capstan roller 105 and a pinch roller 106 forms a conveying mechanism having a large holding force so as to convey the sheet 103 from a recording portion to a discharge portion. A backup roller 107 is an adjustment roller.

When a color recording operation of a plurality of images is performed by superimposing the images in a plane sequential manner such that confirmation of registration (position alignment) is performed by using registration marks "+" as shown in FIG. 16, so-called registration deviation occurs if the sheet conveying mechanism cannot realize a required conveyance accuracy. In this case, there arises problems in that color shift and bleeding occur.

In order to ensure a required conveyance accuracy of a recording sheet conveyed in the grip roller drive method, the surface of the capstan roller 105 is devised (e.g. a roll having a random spray deposit surface) to increase the friction with the reverse side of the sheet 103. As an alternative to this, the material of the surface of the pinch roller 106 is devised to increase the friction with the right side of the sheet 103. Another contrivance has been employed in which the pressure is increased to enlarge the frictional force while the friction factor is maintained.

FIGS. 18A and 18B show the surface condition of a capstan roller having a spray deposit surface: FIG. 18A is an enlarged view of the spray deposit surface; and FIG. 18B is an enlarged sectional view thereof. As shown in FIGS. 18A and 18B, the spray deposit surface is uneven in a random fashion, which has made it unsatisfactory to ensure that a sheet of paper is surely conveyed.

An improvement of the grip belt method shown in FIG. 17 has been employed such that the pair of the rollers is changed to a belt structure. A rubber capstan belt 110 is attached around a pair of rollers 108 and 109. A rubber pinch belt 113 is attached around a pair of rollers 111 and 112. Thus, the area of contact for conveying the sheet is enlarged so as to enlarge the frictional force.

However, there is no definite method capable of improving the registration accuracy in the above described methods. The reason for this lies in that the contrivances of the grip roller method such that the surfaces of the capstan roller 105 and the pinch roller 106 are modified cannot attain a satisfactory effect.

When the pressure is increased, the shaft of the grip roller is warped, and therefore uniform pressure cannot be applied. Although the backup roller 107 may be employed or a separable comb-toothed roller may be employed to press the central portion, delicate adjustment must be performed in the above-mentioned case. Therefore, there arises a problem in that a satisfactory effect cannot be obtained.

When the frictional force is enlarged by changing the grip roller to a belt structure, the area of contact of the belt can be enlarged. However, such a structure can merely obtain almost the same effect as the structure in which the two pairs of grip rollers are provided.

SUMMARY OF THE INVENTION

Accordingly, an object of the present invention is to provide a sheet conveying mechanism for a printer which is capable of accurately conveying a recording sheet by griping the sheet without the problems raised in the methods according to the related art so as to prevent color shift and bleeding when a color image is recorded and which is capable of improving the dimension accuracy of a monochrome image.

In order to achieve the above object, according to an aspect of the present invention, there is provided a sheet conveying mechanism which comprises: a hard pinch roller; and a capstan roller confronting the pinch roller, the capstan roller associating with the pinch roller to convey at least one sheet, and the capstan roller having a surface on which a plurality of projections are formed, wherein height of the projections is 60 $\mu$m±40 $\mu$m, a projection pitch in an axial direction of the capstan roller is 0.5 mm±0.2 mm, and the projections are arranged on half or more of the area of the surface of the capstan roller. More specifically, the pinch roller has a hardness of as high as 55 degrees to 85 degrees (where the hardness is measured by hardness meter JIS K-6301A). This structure enables a sheet conveying mechanism adapted to a grip roller method incorporating the capstan roller and the pinch roller to have enlarged holding force and permits an improvement in the conveyance accuracy to accurately convey a sheet.

According to the other aspect of the present invention, it is preferable that the height of the projections is 60 $\mu$m±15 $\mu$m. This structure enables the sheet conveying mechanism to have enlarged holding force with optimum frictional force and permits an improvement in the paper conveyance accuracy.

According to the other aspect of the present invention, arrangement of the projections may have an angle of 0° with respect to the axial direction of the capstan roller. In this case, it is preferable that the projections are arranged so that one or two projection lines of the projection are simultaneously brought into contact with the pinch roller. Further, according to the other aspect of the present invention, it is preferable that each of the projections has a substantially tree stump shape. On the other hand, each of the projections may have a substantially quarter-spherical shape. In this case, the plurality of quarter-spherical projections may be arranged such that the cross sections of substantially half the quarter-spherical projections face opposite in direction to the cross sections of the rest of substantially half the quarter-spherical projections. This structure ensures that greater holding force is maintained when a sheet is conveyed.

According to the other aspect of the present invention, it is preferable that the sheet conveying mechanism further comprises a backup roller contacting with a substantially central portion of the pinch roller, and pressing the pinch roller toward the capstan roller. In this case, it is preferable that end portions of the backup roller are chamfered and rounded off. According to this structure, concurrent use of even one backup roller realizes similar holding force to what is obtainable from a comb-toothed roller and prevents the surface of the pinch roller from being injured by the end portions of the roll.

The foregoing sheet conveying mechanism according to the present invention is used to convey a sheet in a printer, in particular, to convey a sheet in a thermal printer, to convey a thermoadhesive image receiving sheet, to convey a color thermosensitive sheet and to convey a sheet having a PET support member. When the sheet conveying mechanism according to the present invention is employed in any one of the foregoing printers, the registration accuracy of each printer can be improved.

BRIEF DESCRIPTION OF THE DRAWINGS

FIG. 4A is a diagram showing a projection formed in a tree stump shape; and FIG. 4B is an enlarged perspective view the projections formed in a tree stump shape;

FIG. 5A shows the projections disposed in a check pattern; and FIG. 5B shows the projections disposed in a zigzag manner;

FIG. 6A is a diagram showing a projection formed in a quarter-spherical shape; and FIG. 6B is an enlarged perspective view of the projections formed in a quarter-spherical shape;

FIG. 14 is a diagram showing the contents of evaluation of the sheet conveying mechanism by using the printing image shown in FIG. 13;

DETAILED DESCRIPTION OF THE PREFERRED EMBODIMENTS

First Embodiment

Figure 1:
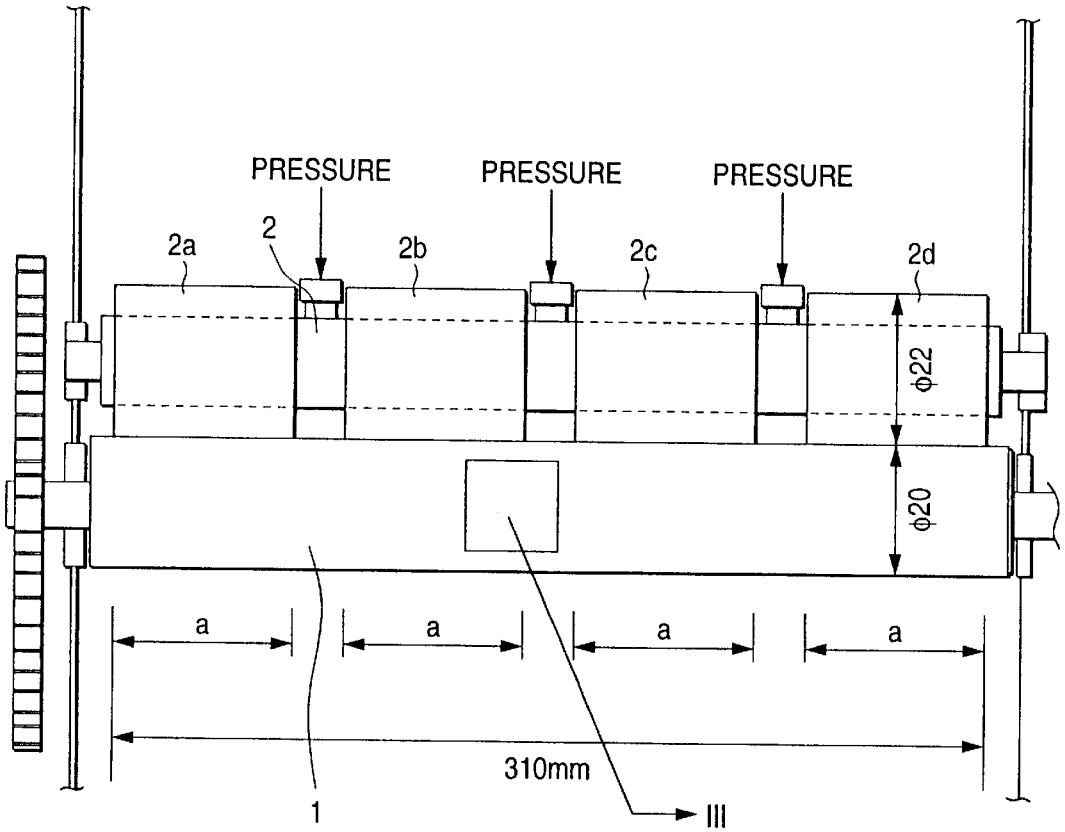
FIG. 1 is a diagram showing the structure of an essential portion of a sheet conveying mechanism according to a first embodiment of the present invention.

A first embodiment of the present invention will now be described with reference to FIGS. 1 to 9B. Referring to FIG. 1, reference numeral 1 denotes a capstan roller embodying the present invention; and reference numeral 2 denotes a pinch roller. A roller pair comprised of the capstan roller 1 and the pinch roller 2 are associated with each other to form a conveying mechanism having strong holding force for conveying sheets of paper through the steps of recording images up to discharging paper.

Figure 2:
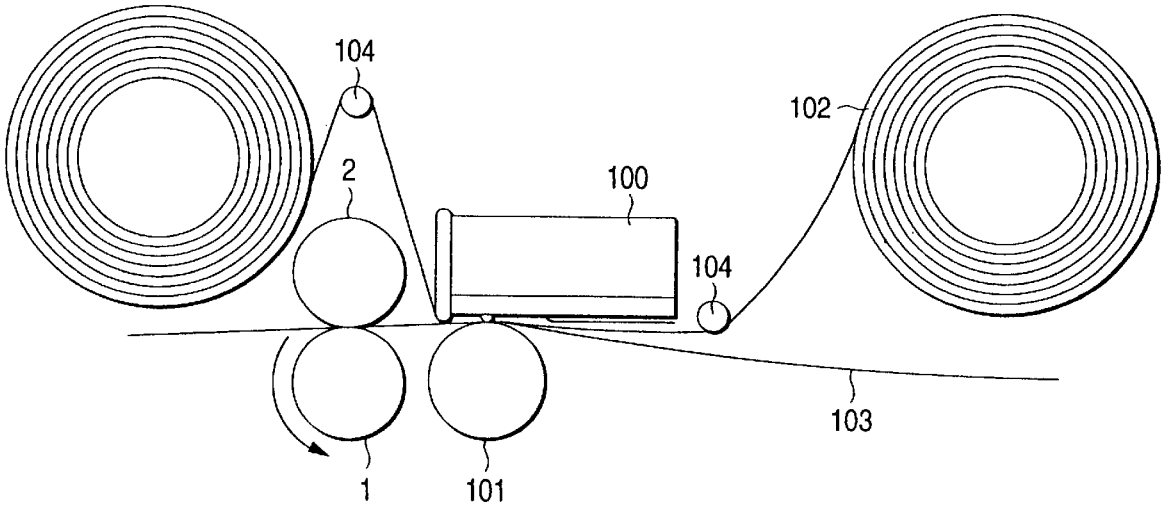
FIG. 2 is an enlarged view showing the surface of the capstan roller shown in FIG. 1.

A thermal printer shown in FIG. 2 employs the capstan roller 1 and the pinch roller 2. The thermal printer further includes a platen roller 101 opposing to a thermal head 100 and used for conveying a recording paper 103 by rotating counterclockwise and simultaneously pressing the recording paper 103 together with a toner ribbon 102. The toner ribbon 102 is guided by the recording paper 103 and a guide roller 104 against the thermal head 100 with a predetermined pressure.

Figure 3A:
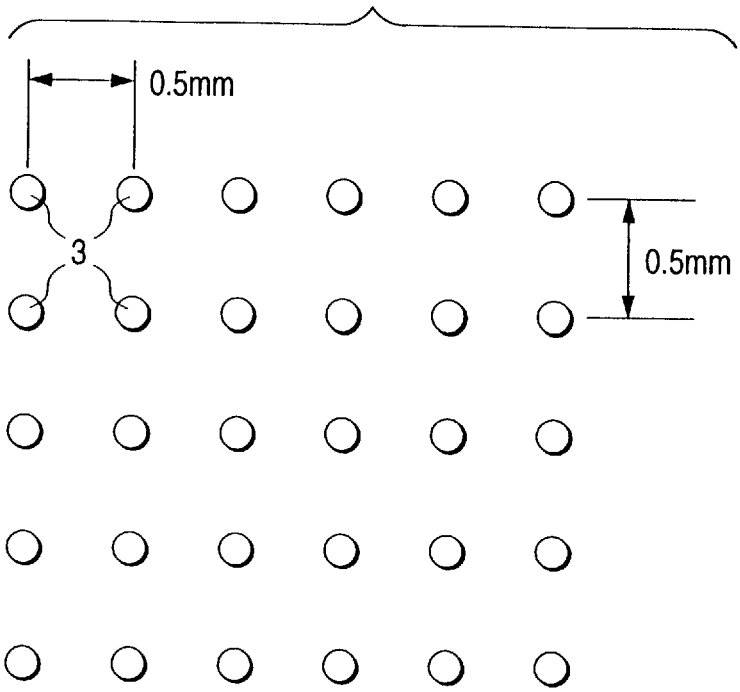
FIGS. 3A and 3B show arrangements of projections on the surface of the capstan roller shown in FIG. 1.
Figure 3B:
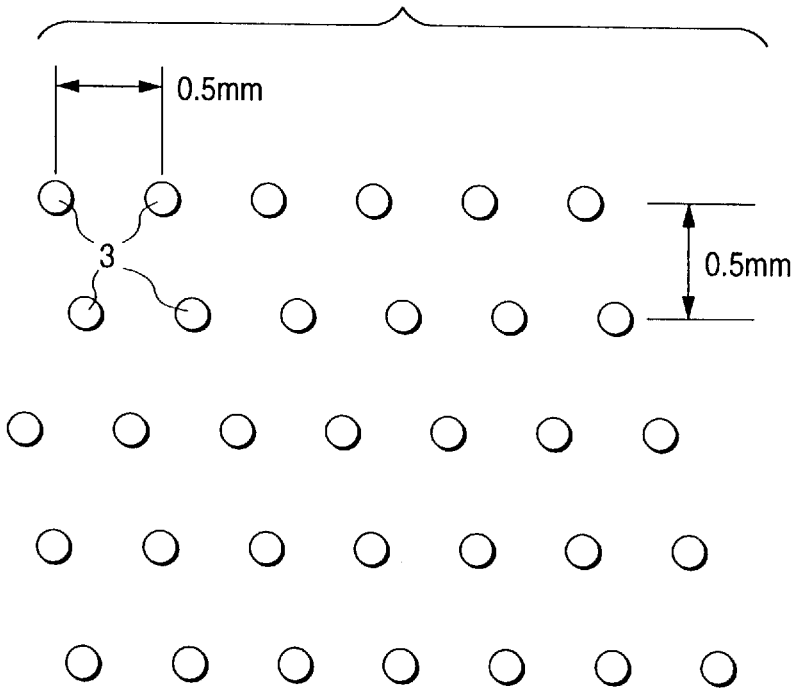

Projections 3 for increasing frictional force are uniformly disposed on the surface of the capstan roller 1 of FIG. 1. Two kinds of arrangement states of the projections 3 are shown in FIGS. 3A and 3B. FIGS. 3A and 3B show an enlarged view of the portion shown by a square III in FIG. 1. The projections 3 are arranged on an elongated plate in parallel to an axial direction of the capstan roller 1. That is, the projections 3 are laterally arranged at a tilted angle of 0° relative to the axis of the capstan roller 1. Further, the projections 3 are axially and circumferentially disposed on the elongated plate at predetermined pitches of 0.5 mm±0.2 mm. The elongated plate is wound around a metal core of the capstan roller 1, and is secured to the metal core by welding or bonging. Therefore, the capstan roller 1 has a so-called grid roller structure.

As shown in FIG. 3A, the projections 3 are arranged in a check pattern in which the projections 3 are axially and circumferentially arranged at right angles. FIG. 3B shows another example in which the projections 3 may be not arranged on the same lines circumferentially, and the arrangement of the projections 3 is to be slightly shifted in a zigzag in the lateral and circumferential directions.

Figure 4A:
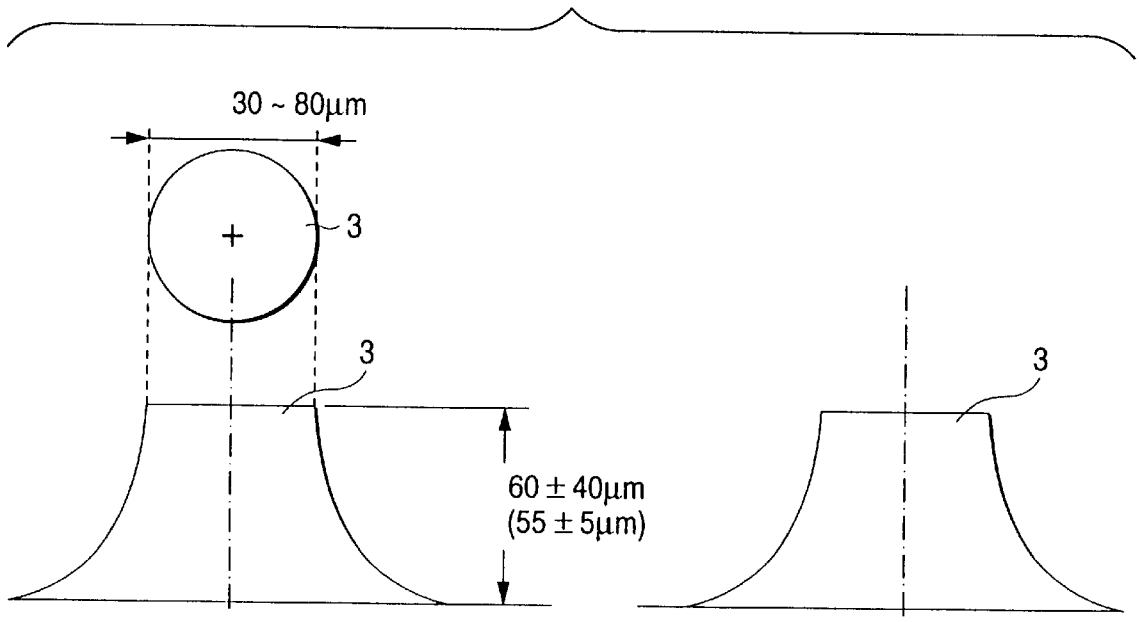
FIGS. 4A and 4B show an example of a specific shape of the projections shown in FIGS. 3A and 3B.
Figure 4B:
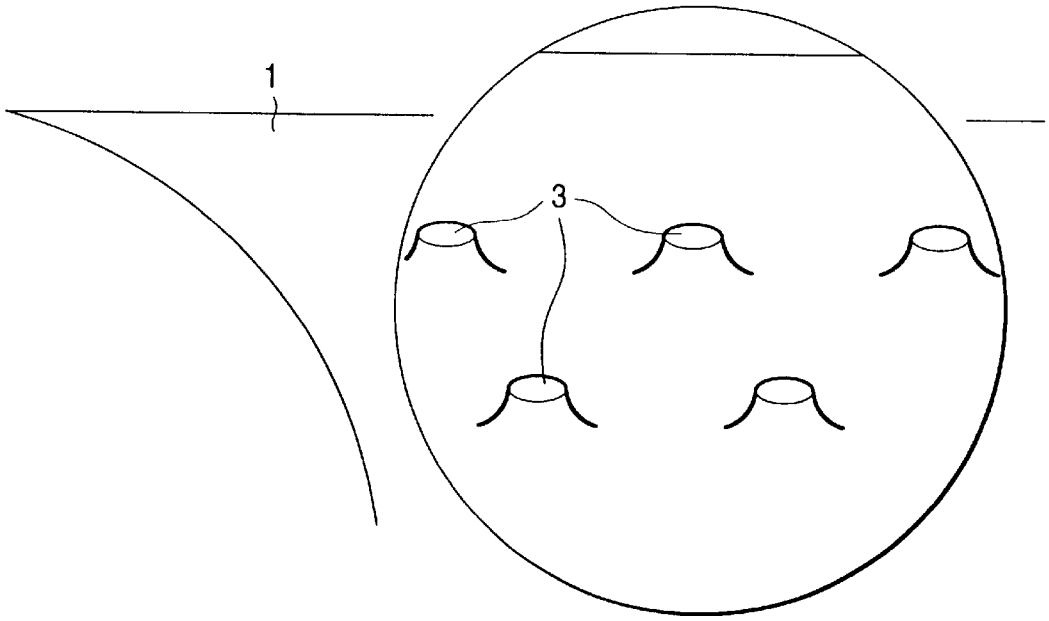

FIGS. 4A and 4B show an example of a specific shape of the projection 3 according to this embodiment. More specifically, an upper view of the projection 3 is shown at the upper left side of FIG. 4A; an elevational view of the projection 3 is shown at the lower left side of FIG. 4A; and a side view of the projection 3 is shown at the lower right side of FIG. 4A. In this example, the projection 3 is protruded in a tree stump-like shape having a height of 60 $\mu$m±40 $\mu$m and a top diameter of 30 $\mu$m to 80 $\mu$m. Especially, the projection 3 having a height of 55 $\mu$m±5 $\mu$m has been found most preferable. FIG. 4B is an enlarged perspective view of the projections 3 arranged in a check pattern as shown in FIG. 3A.

Thus, the conveyance accuracy has been made improvable by axially and circumferentially arranging the projections 3 on the surface of the capstan roller 1 in the check pattern or the zigzag in comparison with the capstan roller of the related art having a spray deposit surface.

A comparison list will be described hereinafter (see FIG. 14).

Figure 5A:
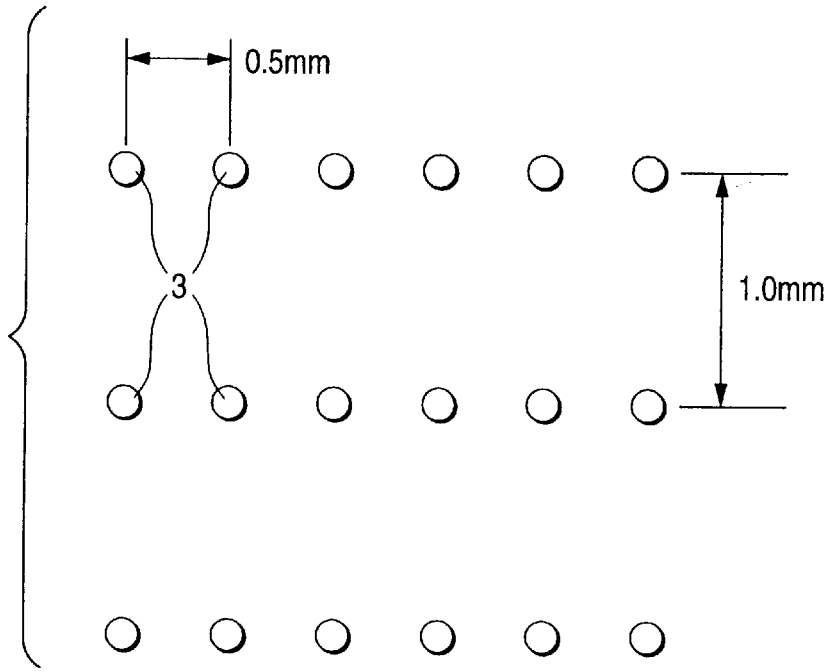
FIGS. 5A and 5B show the other arrangements of projections 3 when the diameter of a capstan roller is twice as large as that of the capstan roller shown in FIGS. 3A and 3B.
Figure 5B:
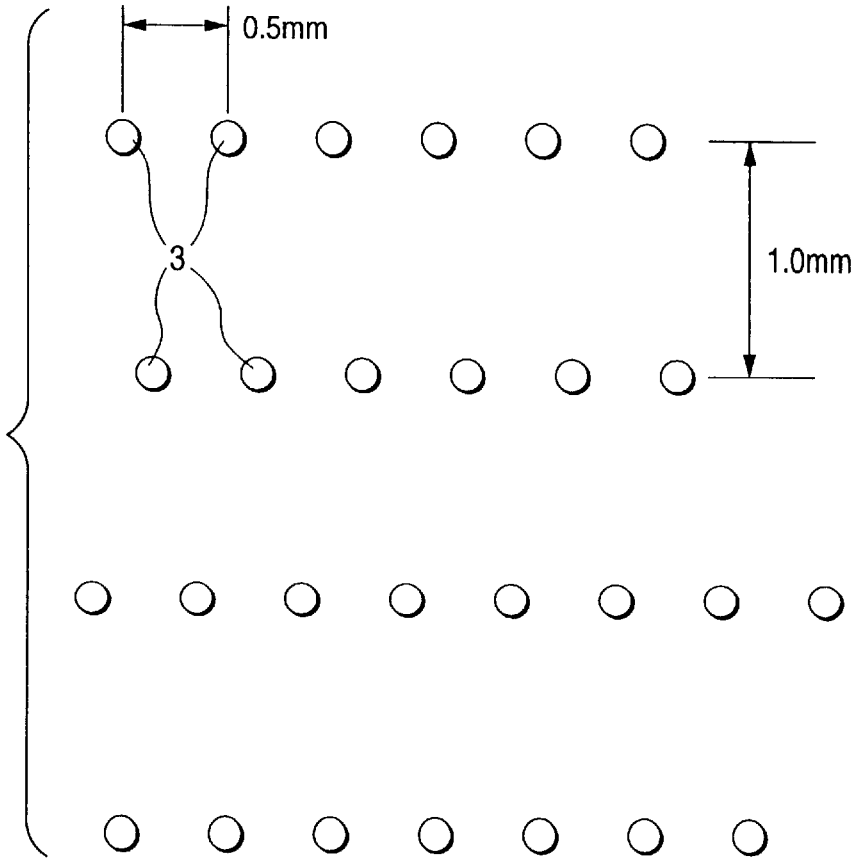

FIGS. 5A and 5B show the other arrangements of the projections 3 when the diameter of a capstan roller is twice as large as that of the capstan roller shown in FIGS. 3A and 3B. FIG. 5A shows the projections 3 arranged in a check pattern; and FIG. 5B shows the projections arranged in a zigzag.

Similar to FIGS. 3A and 3B, the projections 3 shown in FIGS. 5A and 5B are arranged on an elongated plate in parallel to an axial direction of the capstan roller 1. That is, the projections 3 are laterally arranged at a tilted angle of 0° relative to the axis of the capstan roller 1. Also similar to FIGS. 3A and 3B, the projections 3 are axially disposed on the elongated plate at predetermined pitches of 0.5 mm±0.2 mm. However, the projections 3 are circumferentially disposed at predetermined pitches of 1.0 mm which is twice as large as those shown in FIGS. 3A and 3B. According to this arrangement, it has been proved advantageous to change the circumferential pitches each time the diameter of the capstan roller is changed, and further this can be also applied to the pinch roller. Incidentally, it is preferable that the projections are arranged on half or more of the area of the surface of the capstan roller.

Figure 6A:
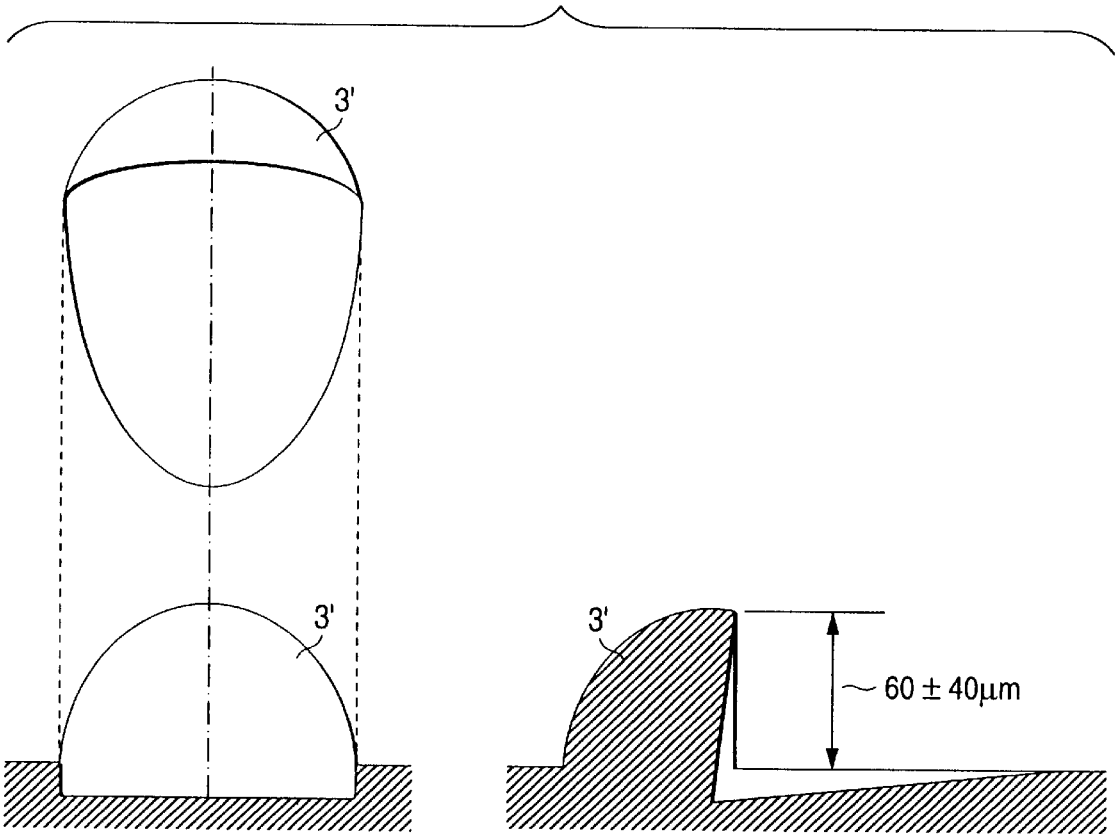
FIGS. 6A and 6B show the other example of a specific shape of the projections shown in FIGS. 3A and 3B.
Figure 6B:
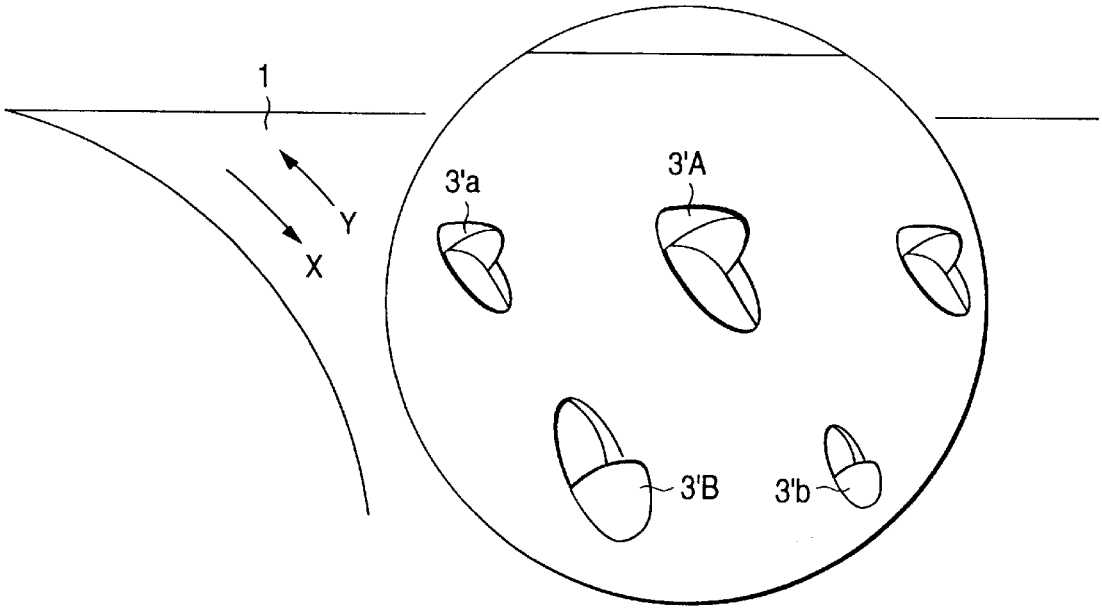
Figure 8:
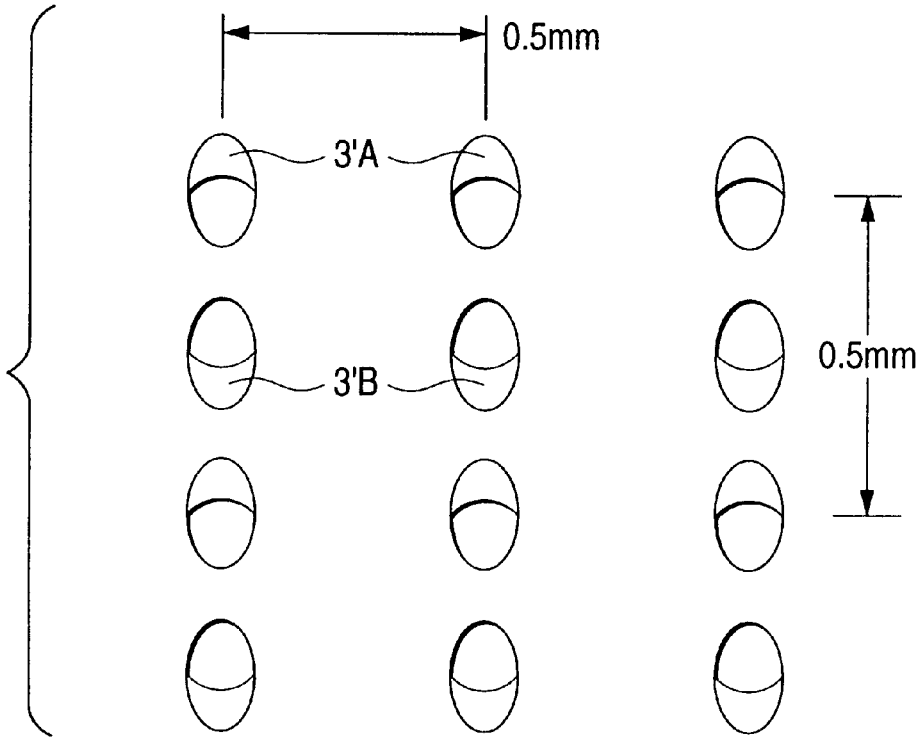
FIG. 8 shows a second embodiment of the arrangement of quarter-spherical projections shown in FIGS. 6A and 6B.

FIGS. 6A and 6B show the projections 3' having a quarter-spherical shape which is different from the projections of FIG. 2 having the tree stump shape shown in FIGS. 4A and 4B. More specifically, an upper view of the projection 3' is shown at the upper left side of FIG. 6A; an elevational view of the projection 3' is shown at the lower left side of FIG. 6A; and a side view of the projection 3' is shown at the lower right side of FIG. 6A. The height of each quarter-spherical projection is set at 60 $\mu$m±40 $\mu$m by way of example. FIG. 6B is an enlarged perspective view of projections 3' disposed as shown in FIG. 8. As shown in FIG. 6B, the projections 3' each has a quarter-spherical shape. The projections 3' can be formed by a process similar to the process for forming projections of a file or a grater. More specifically, the quarter-spherical projections are formed in such a manner that a fine sharp uneven mold is forcibly pressed against the capstan roller 1 to scoop out the metal surface of the capstan roller 1. Afterwards, the metal surface is subjected to plating in order to increase its strength. When the capstan roller 1 having the quarter-spherical projections is rotated, since cross sectional parts of the quarter-spherical projections are stuck into a recording paper, the recording paper is conveyed with great resistance. Thus, greater and highly accurate conveying force is obtained due to the quarter-spherical projections. Moreover, recording paper can be conveyed with greater and highly accurate conveying force in both forward and reverse directions of the capstan roller 1 by varying the cross sectional directions of quarter-spherical projections alternately in the circumferential direction. Furthermore, the provision of different quarter-spherical projections in size ensures conveyance of recording paper, irrespective of the kinds of recording paper.

In FIG. 6B, 3'A denotes a large-sized projection facing downward, 3'*a* denotes a small-sized projection facing downward, 3'B denotes a large-sized projection facing upward, and 3'*b* denotes a small-sized projection facing upward. Therefore, the large-sized projection 3'A and the small-sized projection 3'*a* contribute to the conveyance of paper when the capstan roller is rotated in the direction of X in FIG. 6B, whereas the large-sized projection 3'B and the small-sized projection 3'*b* contribute to the conveyance of paper when the capstan roller is rotated in the direction of Y.

Similar to the tree stump shaped projections, the quarter-spherical projections are arranged in parallel to an axial direction of the capstan roller 1. That is, the quarter-spherical projections are laterally arranged at a tilted angle of 0° relative to the axis of the capstan roller 1. Furthermore, the projections are regularly disposed axially and circumferentially on the elongated plate at predetermined pitches of 0.5 mm±0.2 mm. Incidentally, it is preferable that the projections are arranged on half or more of the area of the surface of the capstan roller.

Figure 7A:
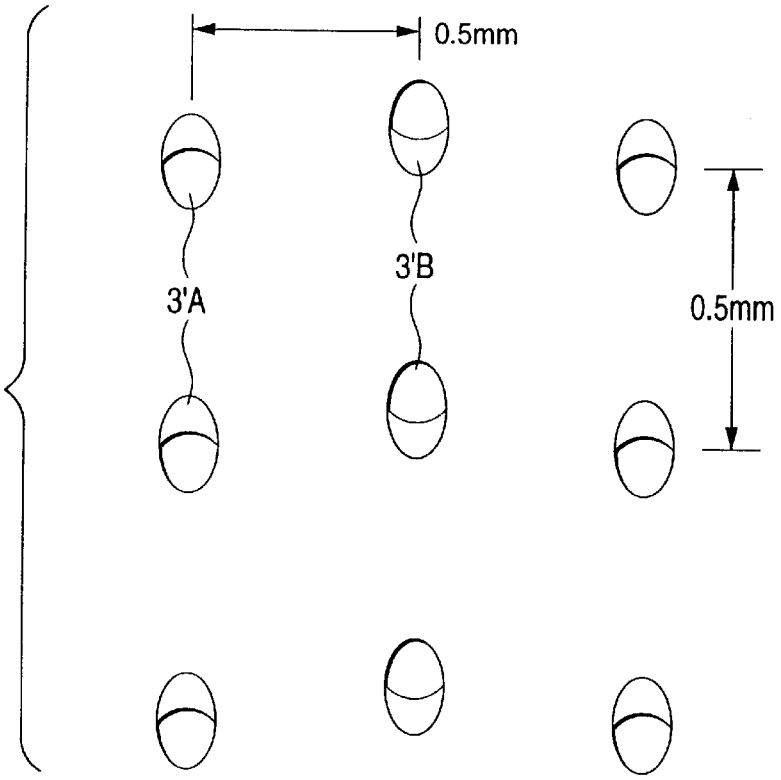
FIGS. 7A and 7B show a first embodiment of the arrangements of quarter-spherical projections shown in FIGS. 6A and 6B.
Figure 7B:
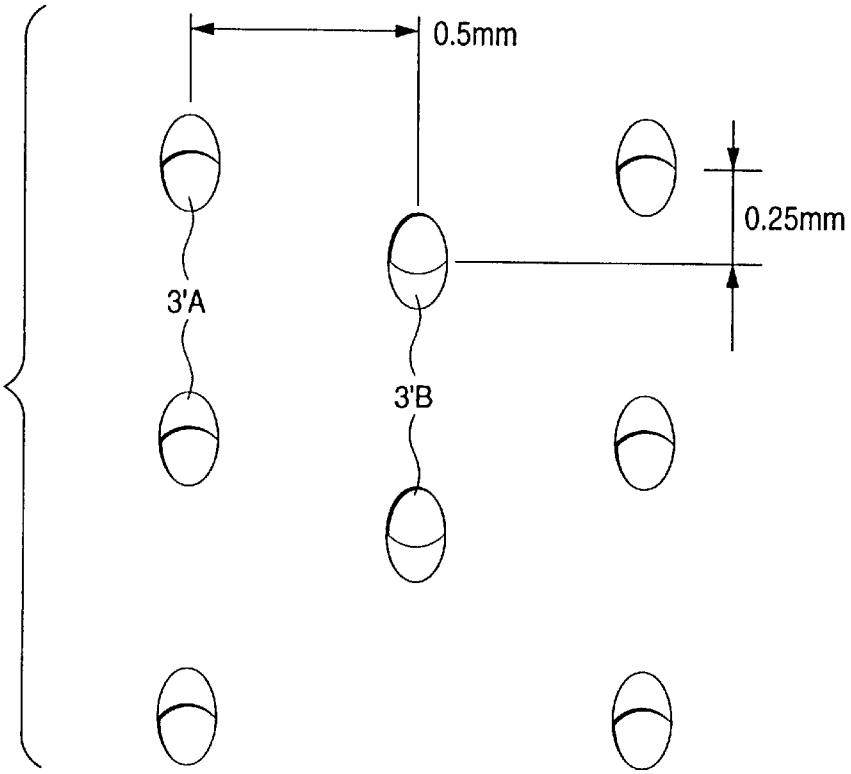

FIGS. 7A, 7B, 8, 9A and 9B show different embodiments of the present invention indicating arrangements of quarter-spherical projections. FIGS. 7A, 7B and 8 show quarter-spherical projections 3'A, 3'B having the same height: FIG. 7A indicates a check pattern. In other words, the check pattern axially and circumferentially has the same pitches of 0.5 mm±0.2 mm and unidirectional projections (e.g., 3'A) are disposed in the circumferential direction with directions of the projections (3' B) being alternately and axially changed.

FIG. 7B indicates a zigzag pattern. In other words, the zigzag pattern axially and circumferentially has the same pitches of 0.5 mm and unidirectional projections (e.g., 3'A) are disposed in the circumferential direction with directions of the projections (3'B) being alternately and axially changed. Consequently, the pitch between a certain projection and what is directly adjacent thereto on the axially adjoining line is set at 0.25 mm.

FIG. 8 is different from FIGS. 7A and 7B in that unidirectional projections (e.g., 3'A) are disposed on the axial line with the directions of the projections (3'B) being alternately and circumferentially changed. FIG. 8 shows a check pattern. The pitches between the unidirectional projections in the axial and circumferential directions are 0.5 mm, respectively.

Figure 9A:
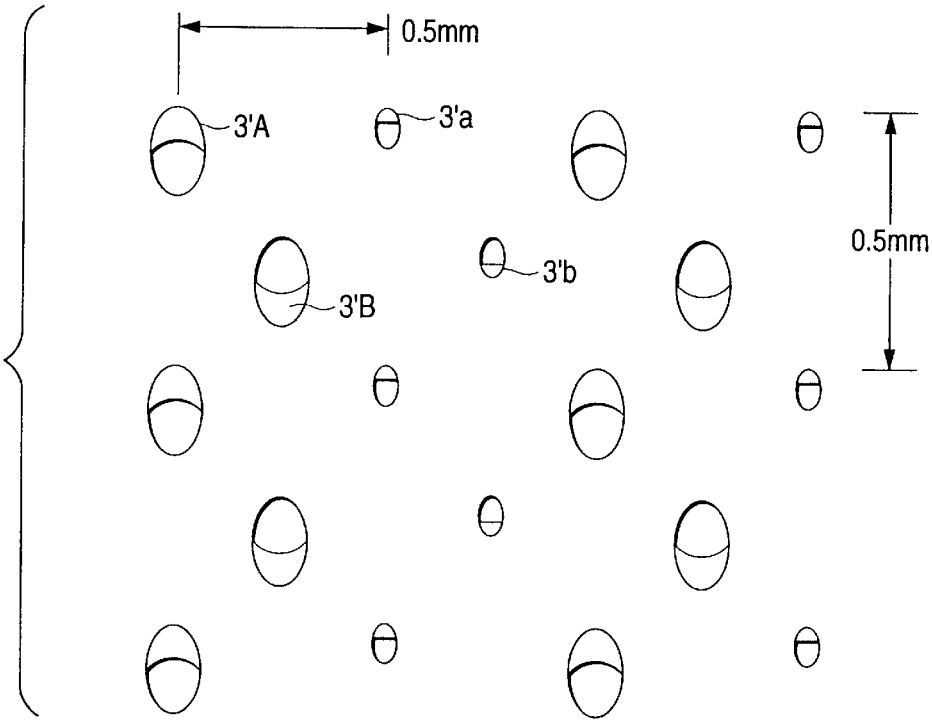
FIGS. 9A and 9B show a third embodiment of the arrangements of quarter-spherical projections shown in FIGS. 6A and 6B.

FIGS. 7A, 7B and 8 refer to cases where the quarter-spherical projections (3'A, 3'B) having the same height are employed, whereas FIG. 9 refers to a case where the quarter-spherical projections 3' (3'A, 3'B, 3'*a*, 3'*b*) different in height are employed. FIG. 9A shows projections in a zigzag where unidirectional projections different in size are alternately and axially are disposed and reverse-directional projections of the same size are disposed circumferentially. The pitches between the unidirectional projections in the axial and circumferential directions are 0.5 mm, respectively.

Figure 9B:
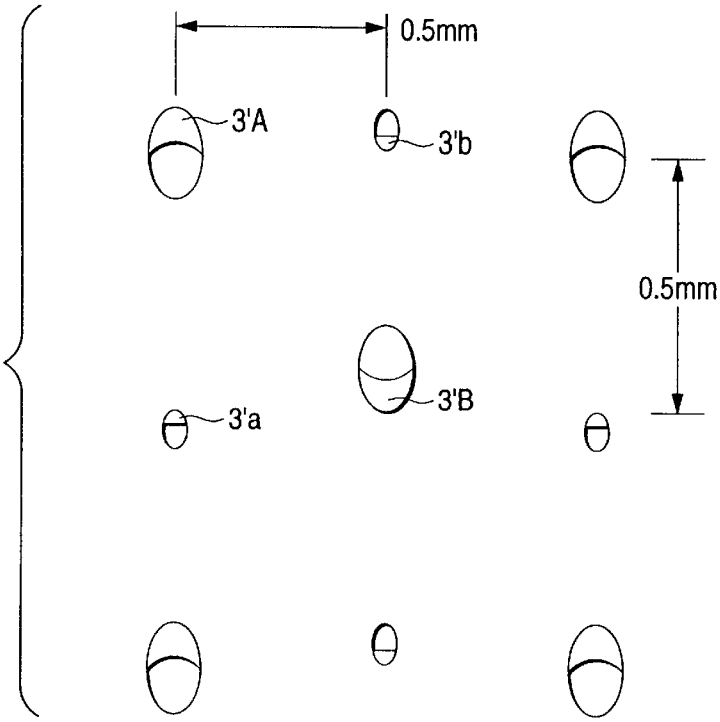

FIG. 9B shows projections in a check pattern where unidirectional projections different in size are alternately and circumferentially are disposed and reverse-directional projections different in size are alternately and axially disposed. The pitches between the adjoining projections in the axial and circumferential directions are 0.5 mm, respectively. According to this embodiment, like the tree stump shaped projections the quarter-spherical projections are directional to ensure the conveyance of recording paper. A comparison list will be described hereinafter (see FIG. 14).

Turning to FIG. 1, reference numeral 2 denotes the pinch roller which forms a pair with the capstan roller 1. In this embodiment, the pinch roller 2 has a comb-toothed structure sectioned into four pieces (2*a*, 2*b*, 2*c* and 2*d*). The comb-toothed rubber members have substantially the same length of a and a high hardness of 65 degrees±10 degrees. Since the roller pair is structured as described above, the frictional force and the holding force can be enlarged. Note that the diameter of the pinch roller 2 is 22 mm, that of the metal core is 16 mm, the overall length of the same is 310 mm and the diameter of the capstan roller 1 is 20 mm.

The recording operation performed by the thermal printer shown in FIG. 2 will now be described. The thermal printer structured as shown in FIG. 2 is used to perform a known thin-layer thermal transfer recording operation (refer to "JAPAN HARDCOPY '97", 79-th annual meeting of Electrophotographic Society, P. 255 to 258 (1997)). A toner ribbon 102 includes a PET film having a thickness of 5 μm coated with coloring material layers of four colors, that is, KCMY (black, cyan, magenta and yellow) each having a thickness of 0.3 μm and coloring-material ratio of 45% and formed at predetermined intervals. An image receiver sheet 103 includes a white PET (polyethylene terephthalate) film which has a thickness of 120 μm and on which a resin layer serving as a cushion layer and having a thickness of 10 μm is formed by coating. A resin layer serving as a thermosensitive image receiving layer and a thickness of 1 μm is applied to the surface of the foregoing cushion layer.

In a state (a head-up state) in which the thermal head 100 has been moved upwards for a height of about 5 mm from the state shown in FIG. 2, the toner ribbon 102 is wound up from a delivery side to a winding side, that is, toward the left-hand portion in the drawing, by a winding motor connected to a winding shaft through a gear. When the leading end of the K, which is the first color, has exceeded the position of a recording heater of the thermal head 100, the toner ribbon 102 is stopped. Then, the image receiver sheet 103 is, by rollers (not shown), conveyed to the left-hand position shown in the drawing. When the leading end of the image receiver sheet 103 has reached a position between the capstan roller and the pinch roller, rotations of the capstan roller 1 in a direction indicated by an arrow shown in the drawing are started. At a position at which the leading end has reliably be nipped between the capstan roller 1 and the pinch roller, the capstan roller 1 is temporarily stopped.

The thermal head 100 has been moved downwards to a position show in FIG. 2 (a head down state). Then, an operation for winding the toner ribbon 102 up is started. Substantially simultaneously, also, conveyance of the image receiver sheet 103 is started. After, time of 100 msec has passed, transmission of strobe signals corresponding to image data to the thermal head 100 is started. Thus, the heater portion is energized and heated so that an image is recorded. At this time, the conveyance of the toner ribbon 102 is controlled by the winding motor. The conveyance of the image receiver sheet 103 is controlled by a motor (not shown) connected to the capstan roller 1 through a gear. The foregoing motors perform control in such a manner that the conveyance speeds of the toner ribbon 102 and the image receiver sheet 103 at the recording position interposed between the thermal head 100 and the platen roller 101 are the same. General conveyance speed is about 5 mm/sec to about 40 mm/sec. When conveyance for a length corresponding to the image region has been completed, the thermal head 100 completes transmission of the strobe signals. Thus, conveyance of the toner ribbon 102 and that of the image receiver sheet 103 are completed. Then, the thermal head 100 is brought to the head up state, and then winding of the toner ribbon 102 is started. When the leading end of C, which is a next color, has exceeded the position of the recording heater of the thermal head 100, the toner ribbon 102 is stopped. Then, the image receiver sheet 103 is conveyed in an opposite direction to the recording direction by inversely rotating the capstan roller 1 to reach the position at which recording of the first color has been started. Then, the image receiver sheet 103 is stopped. Then, operations similar to those required to record the first color are performed so that an image is recorded.

After M and Y images have been recorded by similar operations, the capstan roller 1 is rotated so that the image receiver sheet 103 is discharged from the position between the capstan roller 1 and the pinch roller 2. The discharging direction may be either of the rightward direction or the leftward direction. As a result of the above-mentioned processes, one color image is recorded.

When the registration accuracy of image data in each color is measured by using registration marks, satisfactory prevention of color shift can be confirmed.

When thermal recording is performed, a recording sheet (Thermoautochrome Paper manufactured by Fuji Photo Film Co., Ltd.) for thermal recording is used which is structured such that Y, M and C color developing layers are sequentially formed on a support film made of PET or the like. While a fixing process using light (not shown) or the like is being performed, the recording sheet is heated by the thermal head.

Thus, the color layers are recorded with heat with corresponding thermal energies so that a color image is obtained. The capstan roller 1 is forwards rotated in a direction indicated by an arrow to convey the recording sheet. Thus, the yellow thermal color developing layer is thermally recorded and fixed with light. After recording of the yellow image has been recorded, head-up is performed. Then, the recording sheet is inversely conveyed to the recording start position. When a magenta image is recorded next, the magenta color developing layer is thermally recorded and fixed with light while the recording sheet is being conveyed. Then, head-up is performed, and then inverse conveyance is performed. When a cyan image is recorded next, the recording sheet is conveyed in the forward rotational direction so that the cyan color developing layer is thermally recorded. Thus, the recording operation for each color is performed as described above so that a color image is recorded in the plane sequential manner.

When the registration accuracy is measured by using registration marks, prevention of color shift in the foregoing case can be confirmed.

As described above, the process for recording a color image by the thermal printer adapted to the plane sequential manner requires a considerable registration accuracy for performing an accurate superimposing process. This embodiment has a structure that the capstan roller 1 having the regular projections and the four-piece hard pinch roller 2 are combined with each other. Thus, a conveying mechanism having strong holding force and exhibiting a satisfactory registration accuracy can be formed. Therefore, high-quality color printing can be performed.

Second Embodiment

Figure 10:
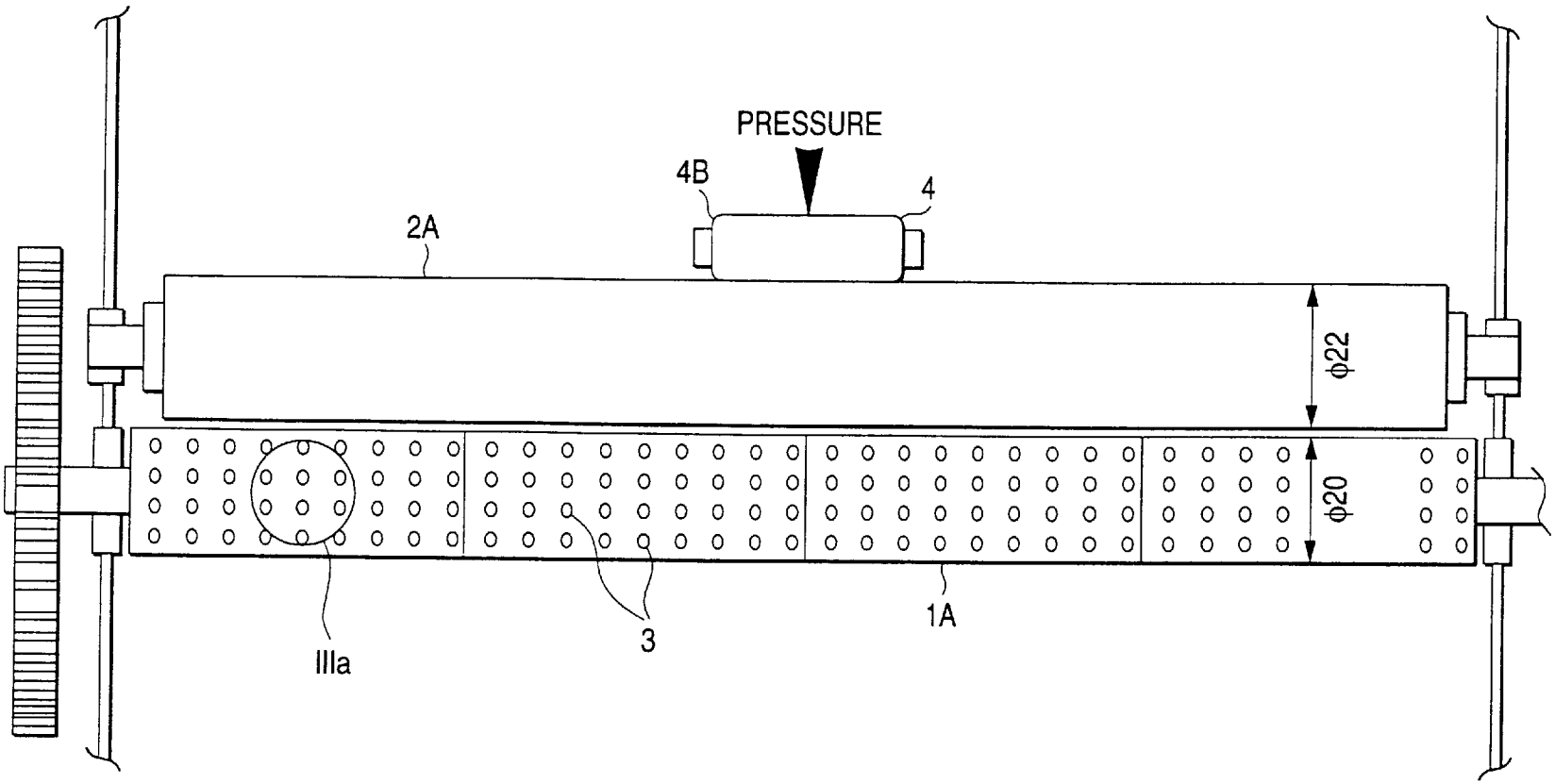
FIG. 10 is a block diagram of the structure of an essential portion of a sheet conveying mechanism according to a second embodiment of the present invention.

A second embodiment of the present invention will be described. FIG. 10 is a diagram illustrating the essential portion of a sheet conveying mechanism of a printer as a second embodiment of the present invention; and FIG. 11, a block diagram of a thermal printer using the sheet conveying mechanism shown in FIG. 1.

In FIG. 10, 1A denotes a projection roller (a capstan roller with projections) having projections 3 uniformly disposed on the surface. The arrangement of projections is such that projections are regularly disposed in a check pattern as shown in FIG. 3A when an enlarged circle III*a* in FIG. 10 is viewed.

Each projection is formed in the tree stump shape and has a height of 55 μm or greater and most preferably 55 μm±5 μm. The pitches are similar to the case of the first embodiment of the invention; namely, p=0.5 mm±0.2 mm is selected from p=a*r, (however r=radius of the capstan roller). Needless to say, the quarter-spherical projections discussed in the first embodiment may be employed instead of the tree stump shape.

The capstan roller 1A is as in the case of the first embodiment of the invention, an elongated plate is wound around a metal core of the capstan roller 1A so as to be secured by welding or bonging, the elongated plate having the surface on which the projections 3 having heights of 55 μm±5 μm are axially and circumferentially disposed in parallel to each other at predetermined pitches of 0.5 mm±0.2 mm, so that the capstan roller 1A has a so-called grid roller structure.

Furthermore, 2A denotes a pinch roller which forms a roller pair with the capstan roller 1A and is not the four-piece comb-toothed pinch roller. The second embodiment of the present invention employs a straight type pinch roller and the hardness of the rubber is 65 degrees+10 degrees (preferably as hard as about 80 degrees). A backup roller 4 is employed to press the central portion. Thus, pressure and holding force similar to those obtainable from the structure incorporating the comb-toothed pinch roller can be obtained. Moreover, the end portions 4B of the backup roller are chamfered and rounded off, so that the rubber base of the pinch roller 2A is prevented from being injured by the end portions 4B of the roll.

Figure 11:
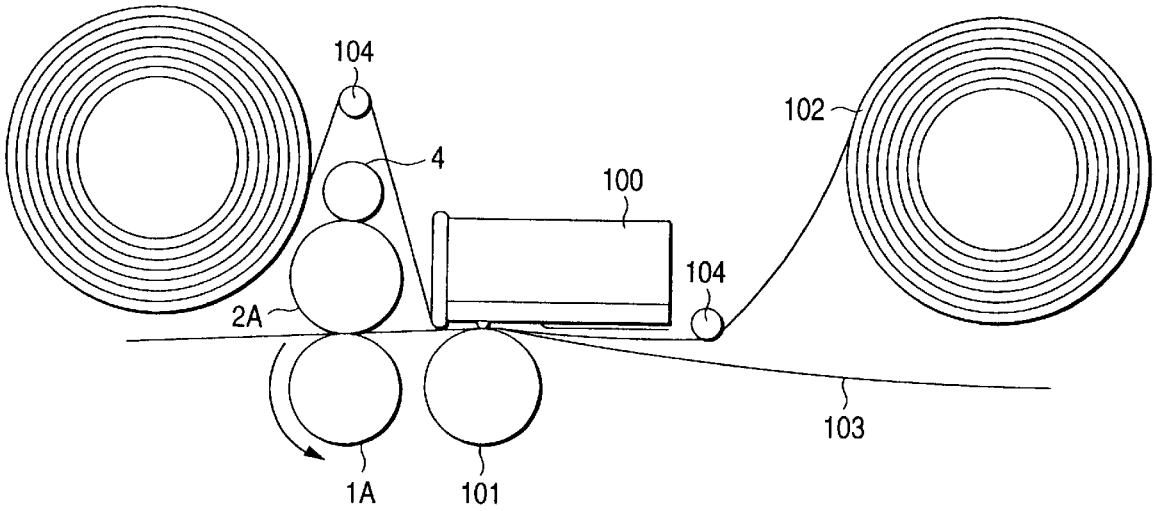
FIG. 11 is a block diagram of a thermal printer using the sheet conveying mechanism shown in FIG. 10.

FIG. 11 is a block diagram of a thermal printer using a sheet conveying mechanism including the capstan roller 1A having the projections 3, the pinch roller 2A and the backup roller 4.

The recording operation is similar to that in the first embodiment of the present invention and when thermal transfer recording is performed, for example, a toner ribbon 102 is wound up by a winding motor connected via a gear to a shaft on the winding side from the delivery side to the winding side, that is, toward the left side in the drawing with a thermal head 100 in such a condition that it has been moved up by about 5 mm (the headup condition) from the state of FIG. 11 and the head of color K as a first color is stopped in a position where the head crosses the recording heater of the thermal head 100. Subsequently, a receiver sheet 103 is conveyed toward the left side of the drawing by rollers (not shown) and when the leading end of the receiver sheet 103 reaches between the capstan roller and the pinch roller, the receiver sheet 103 causes the capstan roller 1A to rotate in the direction of an arrow. Then the capstan roller 1A is stopped once in a position where the leading end of the receiver sheet 103 is nipped in between the capstan roller 1A and the pinch roller 2A.

When the thermal head 100 is moved down (the head-down condition) up to the position in FIG. 11, the winding up of the toner ribbon 102 is started and simultaneously the conveyance of the receiver sheet 103 is also started. The transmission of a strobe signal corresponding to image data toward the thermal head 100 is started 100 msec later and the heater portion is supplied with power and heated for the purpose of recording an image. At this time, the conveyance of the toner ribbon 102 is controlled by the winding motor and that of the receiver sheet 103 is controlled by a motor (not shown) connected via a gear to the capstan roller 1A. These motors are controlled so that the conveyance speed in a recording position among the toner ribbon 102, the receiver sheet 103 of the thermal head 100 and a platen roller 101. The conveyance speed is generally set at about 50 mm to 40 mm/sec. At a point of time when length equivalent to an image area is completely covered, the thermal head 100 completes not only the transmission of the strobe signal but also the conveyance of the toner ribbon 102 and the receiver sheet 103. The thermal head 100 is placed in the head-up condition and the winding of the toner ribbon 102 is started and stopped where the head of color C as the next color crosses the recording heater position of the thermal head 100. Subsequently, the capstan roller 1A is reversely rotated so as to convey the receiver sheet 103 in the direction opposite to the recording direction up to the first color recording start position. Then the image recording is performed like the first color until four-color heat transfer recording is performed. Thermal transfer recording is performed in the same manner as in the first embodiment of the invention.

According to the second embodiment of the present invention, with the provision of the capstan roller 1A formed with trains of axially parallel projections having pitches of 0.5 mm±0.2 mm and heights of 55 μm±5 μm, the straight type pinch roller 2A with a rubber hardness of about 80 degrees and the chamfered backup roller 4 results in increasing the holding force and registration accuracy of the sheet conveying mechanism far greater than the case of the first embodiment thereof due to the effect of forming projections having optimum heights, thus making possible high-quality color printing.

Third Embodiment

Figure 12:
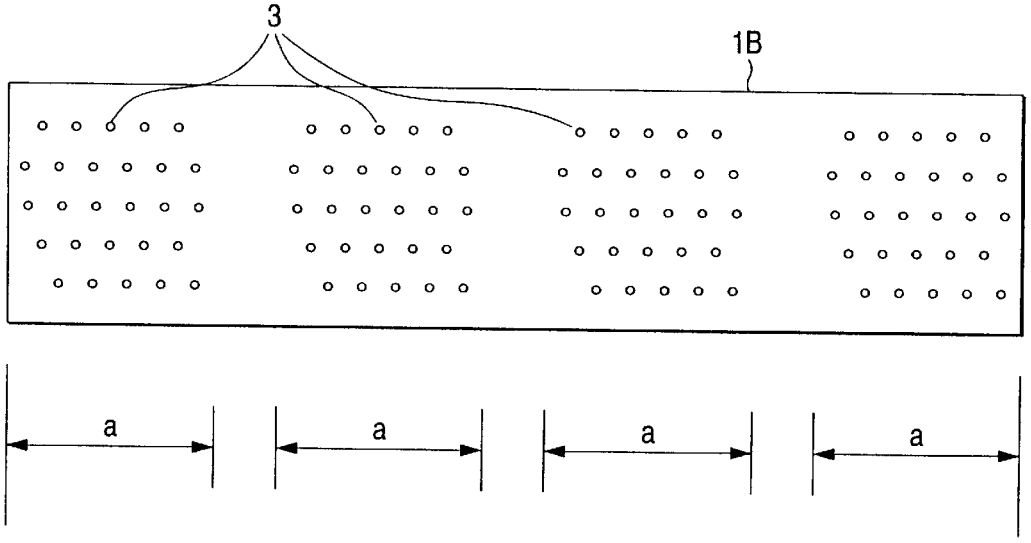
FIG. 12 is a diagram showing the surface of a capstan roller according to a third embodiment of the present invention.

A third embodiment of the invention will be described. FIG. 12 is a diagram showing the surface of a capstan roller according to the third embodiment of the invention. The structure of the third embodiment shown in FIG. 12 is different from the diagram showing the surface according to the first embodiment shown in FIG. 1 and from the diagram showing the surface according to the second embodiment shown in FIG. 10 in that the projections 3 are not arranged on the overall surface of the capstan roller 1B. In this embodiment, the projections 3 are formed in a portion of the capstan roller 1B. For example, the projections 3 are formed in only a portion corresponding to the length a of each of the comb-toothed pinch rollers 2*a*, 2*b*, 2*c* and 2*d* shown in FIG. 1. Thus, no projection is formed in an intermediate portion which is not brought into contact with the pinch roller 2.

The aforesaid arrangement of the projections 3 enables an effect similar to that obtainable from the first embodiment of the invention to be obtained.

Figure 13:
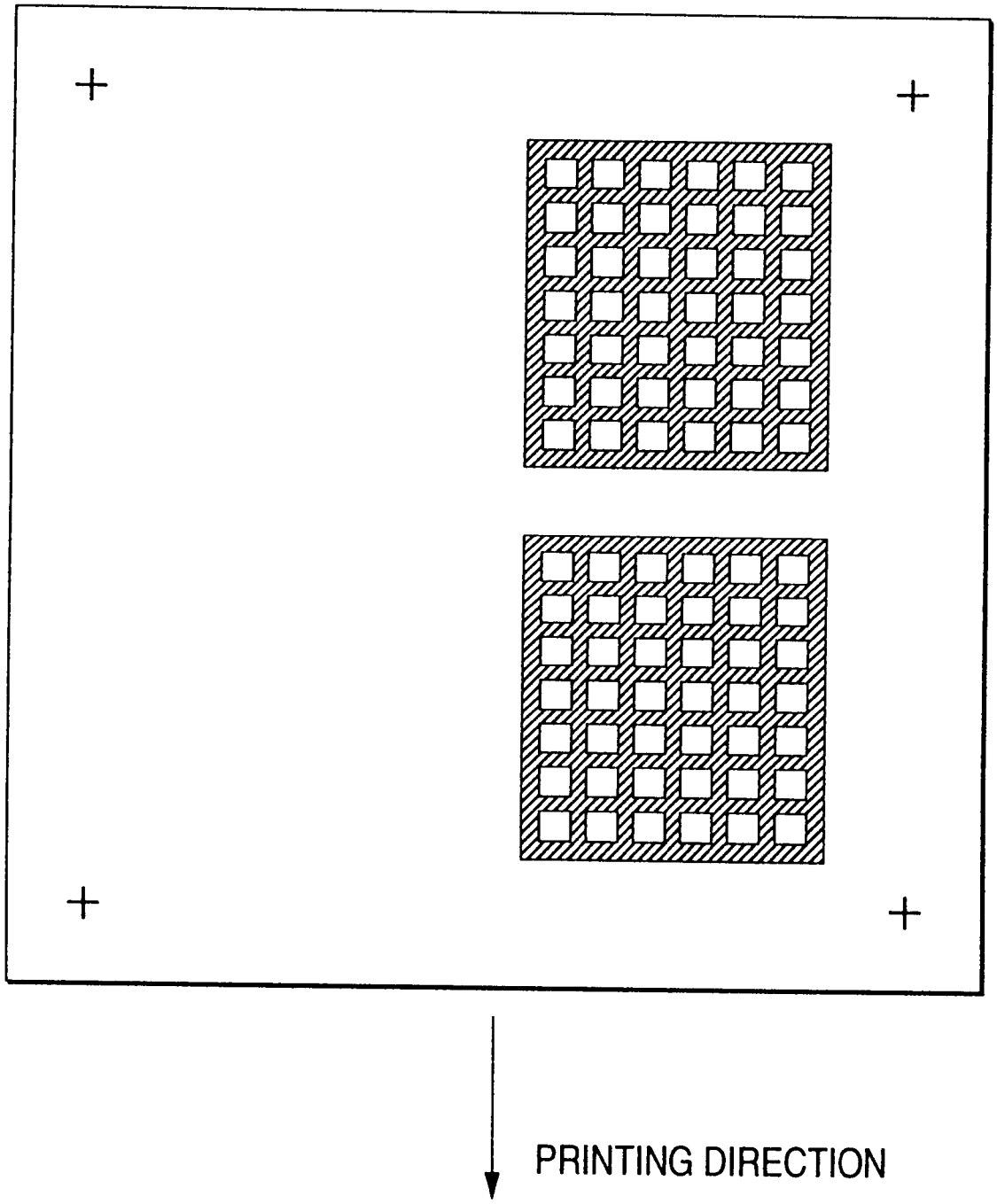
FIG. 13 is a diagram showing an example of an image in order to evaluate the sheet conveying mechanism for a printer according to the present invention.
Figure 15:
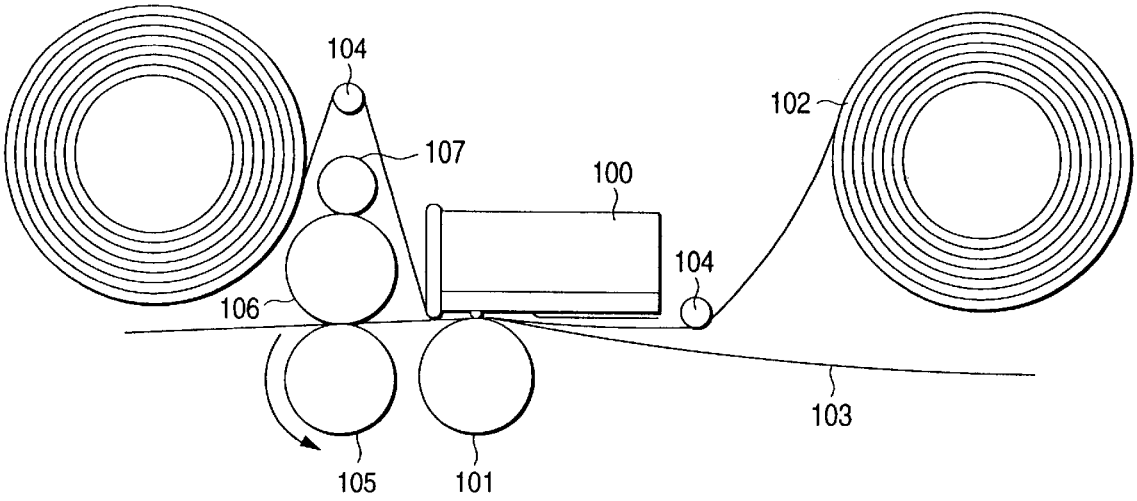
FIG. 15 PRIOR ART
FIG. 15 is a diagram showing the structure of a grip roller type sheet conveying mechanism of the related art.
Figure 16:
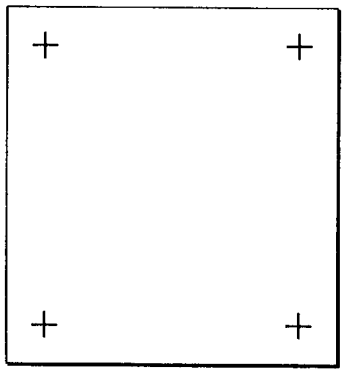
FIG. 16 PRIOR ART
FIG. 16 is a diagram showing an example of registration marks.
Figure 17:
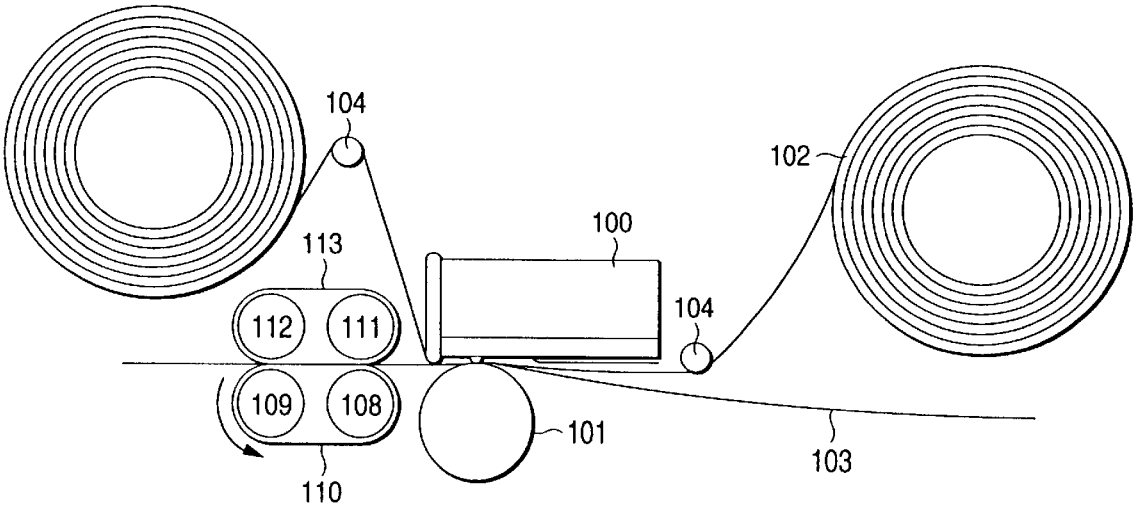
FIG. 17 PRIOR ART
FIG. 17 is a diagram showing the structure of a grip belt type sheet conveying mechanism of the related art.
Figure 18A:
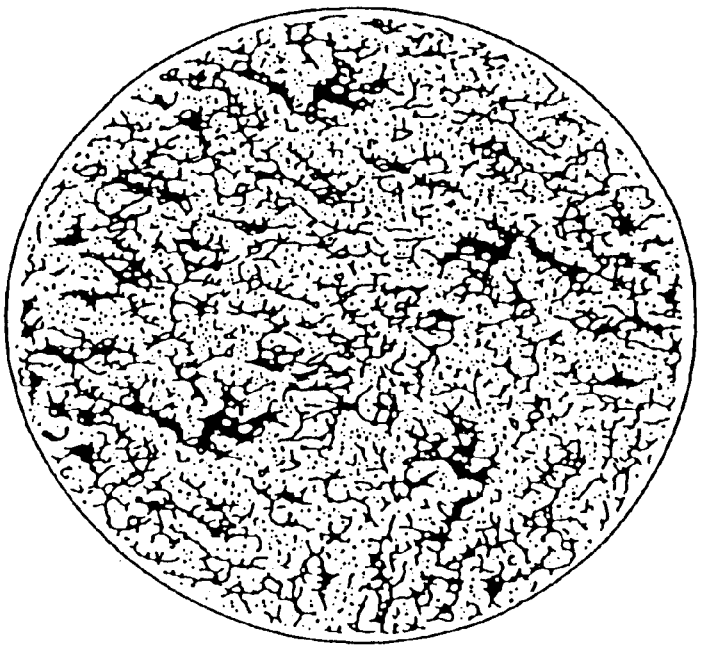
FIG. 18A PRIOR ART
FIGS. 18A and 18B show an enlarged surface of a capstan roller having a spray deposit surface.
Figure 18B:
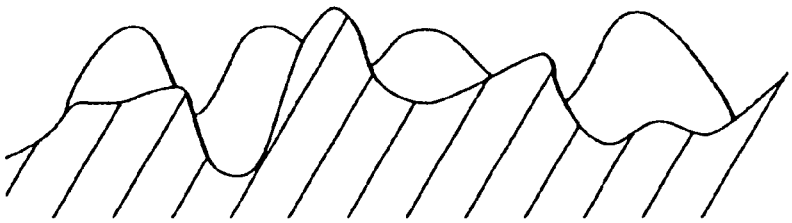
FIG. 18B PRIOR ART

Effects obtained when the conveying mechanism for a printer according to the present invention were evaluated by using results of recording an image (LAT4) which must be printed and which was formed as shown in FIG. 13. The evaluation was performed in accordance with results of alignment (registration accuracy) shown in a table shown in FIG. 14. The evaluation was performed such that the image (LAT4) which was formed as shown in FIG. 13 and which must be printed was employed. Four halftone color images formed into a lattice shape were recorded on only one side of the image which must be printed in the sub-scanning direction (the printing direction) such that registration marks at four corners were superimposed. Since the image shown in FIG. 13 is the one-side image, the superimposition (the registration) of the four colors are disordered if the conveying force has a problem. Since the registration can therefore satisfactorily be evaluated, the foregoing image was employed.

The evaluation test was performed such that the set torque for the toner winding shaft was varied. Three sheets were printed with each torque to measure the amount of deviation of four-color registration marks by using a magnifier. If the amount of deviation is not greater than 100 μm, the sample was evaluated as satisfactory. If the amount is greater than 100 μm, the number of the sheets were evaluated as a defective number of sheets. In this case, the samples given 0 are satisfactory samples. The samples given the other numbers are defective.

The table shown in FIG. 14 shows results of the evaluation of the registration (the alignment) accuracy realized by combinations of a variety of capstan rollers and pinch rollers, the result being shown in the form of a table. Columns in the table will now be described toward the right-hand portion in the table, while the describing order is given numerals 1 to 4.

(1) Types of capstan rollers: a roll of the related art having a spray deposit surface, a grid (projection) roller according to the present invention provided with projections each having a height of 60 μm and arranged at pitches of 0.5 mm as the first embodiment thereof and a grip roller provided with projections each having a height of 80 μm and arranged at pitches of 0.3 mm as a comparative example and lastly a grip roller provided with projections each having a height of 55 μm and arranged at pitches of 0.5 mm as the second embodiment thereof.

(2) Types of pinch rollers: the pinch rollers were classified in accordance with whether or not the roller is the comb-toothed roller or the straight pinch roller provided with the backup roller.

(3) Types of images: image LAT4 and LAT2 in four colors which must be printed and the number of sheets (n=3) are shown.

(4) Torque of toner winding shaft: the torque satisfies a range from 2.00 Kgf/cm to 11.00 Kgf/cm.

As can be understood from the results of the evaluation shown in FIG. 14:

(1) the rollers of the related art each having the spray deposit surface and comb-toothed rollers having hardness of 40 degrees (comparative example 1) 50 degrees (comparative example 2) and 70 degrees (comparative example 3) usually show the fact that all of the three sheets are defective because the amount of deviation of the registration marks exceed 100 μm.

(2) On the other hand, the so-called tree stump shaped projections (hereinafter called a type projections) of the grid rolls with heights of 60 μm at pitches of 0.5 mm as shown in FIGS. 4A and 4B in the first embodiment of the present invention, are able to considerably improve the registration accuracy in the cases where the tomb-toothed pinch rollers have a hardness of as high as 60 degrees (the first embodiment) and 70 degrees (the second embodiment).

(3) Even for the grid rolls with heights of 60 μm at pitches of 0.5 mm, the amount of deviation of the registration marks increases (three sheets out of the three sheets) in the cases where the tomb-toothed pinch rollers have a hardness of 40 degrees (the comparative examples 4, 5) and 50 degrees (the comparative example 6).

(4) For the grid rolls at pitches of 0.3 mm, the amount of deviation of the registration marks also increases (three sheets out of the three sheets) in the cases where the comb-toothed pinch rollers have a hardness of as high as 70 degrees (the comparative example 7) and a height greater than the optimum value (55 μm±5 μm) and increased up to 80 μm. When the heights of the projections are increased like this, uneven color density is produced in images corresponding in position to the projections.

(5) For the grid rolls with the a type projections having optimum heights of 60 μm within (55 μm±5 μm), the amount of deviation of the registration marks remains one sheet (the comparative example 8) in the case of the straight pinch roller having a hardness of as low as 50 degrees with the backup roll of the second embodiment of the present invention. However, the amount of deviation of the registration marks becomes 0 (the third embodiment) when the hardness is increased to (70 degrees).

(6) For the grid rolls with the a type projections having optimum heights of 55 μm within (55 μm±5 μm), the amount of deviation of the registration marks becomes 0, irrespective of the type of image LAT (LAT4=the fourth embodiment, LAT2=the fifth embodiment), in the case of the straight pinch roller having a hardness of 80 degrees which is higher than 70 degrees with the backup roll of the second embodiment of the present invention.

(7) Although the a type projections are employed in the embodiments 1 to 5 of the present invention, the quarter-spherical projections (hereinafter called the b type projections) are employed in the embodiments 6 to 8 as shown in FIGS. 5A and 5B.

The grid rollers with the b type projections have heights of 50 μm in the sixth embodiment of the present invention, 60 μm in the seventh embodiment thereof and 70 μm in the eighth embodiment thereof at pitches of 0.5 mm, and the straight pinch roller has a hardness of 70 degrees with the backup roll. As is obvious from this structure, the amount of deviation of the registration marks becomes 0, irrespective of the height of quarter-spherical projections ranging from 50 μm to 70 μm. In other words, the quarter-spherical projections offer excellent conveyance force and great accuracy.

As described above, according to the present invention, a sheet conveying mechanism for a printer, such as a thermal printer comprises: a capstan roller and a pinch roller forming a pair with the capstan roller so as to convey sheets, wherein the capstan roller is a capstan roller provided with projections having heights of 60 μm±40 μm and preferably 60 μm±15 μm and pitches of 0.5 mm±0.2 mm and arranged on the overall surface thereof, and the pinch roller is a pinch roller having high hardness. Therefore, the problem of the registration deviation experienced with the related art structure can be prevented and the recording sheet can strongly be held. As a result, the sheet can accurately be conveyed. When a color image is recorded, color shift and bleeding can be prevented. When a monochrome image is recorded, the dimension accuracy of the image can be improved.

Although the description has been made about a structure for recording an image, the present invention is able to improve the accuracy of the recording position when the pinch roller is adapted to a tape for recording data except for the image. The present invention may be applied to, for example, an LED head, a laser head, an ink jet head, a DMD head, an EL head and a liquid crystal head to obtain a similar effect.

What is claimed is:

1. A printer for recording an image by thermal transfer on a sheet, the printer provided in a combination with a toner sheet, the printer of said combination comprising a sheet conveying mechanism including:

a hard pinch roler; and a capstan roller confronting the pinch roller, the capstan roller associating with the pinch roller to conveey at least one sheet, and the capstan roller having a surface on which a plurality of projections are formed, wherin a height of the projections is 60 μm, a projection pitch in an axial direction of the capstan roller is 0.5 mm ± 0.2 mm, and the projections are arranged on half or more of an area of surface of the capstan roller, wherein the printer is a thin-layer thermal transfer printer which records the image by thermal transfer on the sheet, and the toner sheet containing 30 to 70 parts by weight of pigments and 25 to 60 parts by weight of organic amorphous high polymers having a softening point of 40° C. to 150° C. and a thickness of 0.2 μm to 1.0 μm and containing a coloring material, and the sheet having a thermoadhesive image receiving layer so that thermal transfer recording is performed by bringing the toner sheet and the sheet into close contact with each other such that the sheet is conveyed by an association of the capstan roller and the pinch roller.

2. The sheet conveying mechanism of claim 1, wherein the sheet includes a PET support member.

3. A printer for recording an image by thermal fransfer, the printer being in a combination with a thermosensitive sheet, the printer of said combination comprising:

a sheet conveying mechanism including:

a hard pinch roller; and a capstan roller confronting the pinch roller, the capstan roller associating with the pinch roller to convey at least one sheet, and the capstan roller having a surface on which a plurality of projections are formed, wherein a height of the projections is 60 μm ± 40 μm, projection pitch in an axial direction of the capstan roller is 0.5 mm ± 0.2 mm, and the projection are arranged on half or more of an area of a surface of the capstan roller, the sheet conveying mechanism which records an image on the sheet while conveying the sheet by an association of the capstan roller and the pinch roller;

wherein the sheet is a color thermosensitive paper, the printer is a color thermosensitive paper printer which records the image by color thermosensitive recording on the color thermosensitive paper in a planar sequential manner.

4. A sheet conveying mechanism, comprising:

a hard pinch roller;

a capstan roller confronting the pinch roller, the capstan roller associating withe the pinch roller to convey at least one sheet, and the capstan roller having a surface on which a plurality of projections are formed; and a backup roller contacting with a substantially central portion of the pinch roller, and pressing the pinch roller toward the capstan roller, wherein a heigh of the projections is 60 μm ± 40 μm, a projection pitch in an axial direction of the capstan roller is 0.5 mm ± 0.2 mm, and the projections are arranged on half or more of an area of a surface of the capstan roller.

5. A sheet conveying mechanism, comprising:

a hard pinch roller;

a capstan roller confronting the pinch roler, the capstan roller associating with the pinch roller to convey at least one sheet, and the capstan roller having a surface on which a plurality of projections are formed; and a backup roller contacting with a substantially central portion of the pinch roller, and pressing the pinch roller toward th capstan roller, wherein a height or the projections is 60 μ m ±40 μm, a projection pinch in an axial direction of the capstan roller is 0.5 mm ± 0.2 mm, and the projections are arranged on half or more of an area of a surface of the capstan roller, and wherein end portions of the backup roller are chamfered and rounded off.

* * * * *